United States Patent [19]

Richter

[11] Patent Number: 5,037,337

[45] Date of Patent: Aug. 6, 1991

[54] STEERABLE PROPELLER DRIVE APPARATUS

[76] Inventor: Larry D. Richter, 1721 Port Clinton Rd., Fremont, Ohio 43420

[21] Appl. No.: 653,979

[22] Filed: Feb. 11, 1991

Related U.S. Application Data

[63] Continuation-in-part of Ser. No. 432,486, Nov. 7, 1989, abandoned.

[51] Int. Cl.[5] ..... B63H 5/12

[52] U.S. Cl. ..... 440/57; 440/83; 440/51

[58] Field of Search ..... 440/51, 53, 57, 61–64, 440/66, 79, 83; 464/139, 140, 141, 150, 152–156; 403/359, 298

[56] References Cited

U.S. PATENT DOCUMENTS 4,565,532 1/1986 Connor ..... 440/57
4,645,463 2/1987 Arneson ..... 440/57
4,726,796 2/1988 Rivette, Jr. et al. ..... 440/57

*Primary Examiner*—Ed Swinehart
*Attorney, Agent, or Firm*—Marshall & Melhorn

[57] ABSTRACT

The invention comprises a steerable propeller unit for use in place of a steerable rudder and fixed propeller on watercraft employing inboard straight line propulsion systems. A coupler is fitted to the rear of the drive shaft projecting from the craft in place of a propeller. The coupler is affixed to a splined shaft which, in turn, is connected to a universal drive joint. A pivotable rudder shaft interconnects with the steering mechanism for the craft, and carries at its lower end a strut bearing. A short shaft connected to the universal joint extends through the strut bearing, and the propeller is affixed to the shaft behind the strut bearing. The propeller may thus be swung through an arc to either side of the center line of the craft by the steering mechanism. Top, bottom and side rudder plates may optionally be affixed to the strut bearing assembly.

11 Claims, 2 Drawing Sheets

STEERABLE PROPELLER DRIVE APPARATUS

This is a continuation-in-part of application Ser. No. 07/432,486 filed Nov. 7, 1989 now abandoned.

BACKGROUND OF THE INVENTION

1. Field of the Invention

The present invention pertains generally to the propulsion and steering of watercraft, and more particularly to a steerable propeller assembly applicable to such craft powered by conventional inboard mounted engines driving a straight line drive propeller shaft.

2. Description of the Prior Art.

Conventional inboard straight line drive powered boats are driven by means of a propeller affixed to the end of a rigidly mounted propeller shaft extending toward the stern of the vessel. Steering of the vessel is accomplished by a rudder disposed in the water at the rear thereof which is pivoted to an appropriate angular position so that water moving therepast provides a lateral thrust component causing the rear of the vessel to be displaced laterally In order to provide this steering thrust the rudder must, of course, be moving relative to the water, that is, the water must be moving along and past the rudder surfaces, due either to movement of the boat through the water or movement of water past the rudder by the propeller. Thus, while steering is readily accomplished at relatively high speeds, the rudder has very limited effectiveness at low speeds such as those necessary in maneuvering in and out of docking spaces and in harbor and marina areas. Due to the great increase in the number of boats in use in recent years, harbors and marinas have become increasingly congested, and maneuvering within such areas has become more difficult.

Watercraft powered by outboard engines and stern power out-drive units, the so-called "L" and "Z" drive units, respectively, are much more maneuverable than conventional inboard straight line drive powered vessels. The propellers of such craft can be swung in an arc to either side of the center line of the vessel to provide a component of direct lateral thrust to the stern of the craft. The thrust will thus swing the stern around without the necessity for linear movement of the craft through the water.

The merits of steerable propellers in guiding conventional inboard straight line drive powered watercraft are well recognized, and efforts have long been directed toward providing such devices which will function satisfactorily. U.S. Pat. No. 10,790, issued Apr. 18, 1854, discloses one early effort wherein a propeller and rudder are so mounted as to be pivotable. Steerable propeller arrangements are likewise disclosed in U.S. Pat. Nos. 135,404, issued Feb. 4. 1873; 189,603, issued Apr. 12, 1877; 571,127, issued Nov. 10, 1896; 2,398,033, issued Apr. 9, 1946; and 4,310,319, issued Jan. 12. 1982 While the advantages of having the ability to pivot or swing the axis of rotation of propellers have long been recognized, none of the mechanisms proposed thus far for use with inboard straight line drive systems has proven entirely satisfactory for that purpose. Thus, there remains a need for a mechanism which is relatively simple and inexpensive to manufacture, can be readily installed on both new and existing vessels, and is durable and relatively maintenance free.

SUMMARY OF THE INVENTION

In accordance with the invention, there is provided a steerable propeller unit which is adapted for use in place of the steerable rudder and fixed propeller conventionally employed with watercraft having inboard straight line propeller shaft propulsion systems. A coupler is fitted to the end of the shaft projecting from the watercraft in place of the propeller. The coupler carries a splined shaft which, in turn, is connected to a universal joint. A moveable rudder shaft interconnects with the steering mechanism for the craft and carries at its lower end a strut bearing. A short shaft connected to the universal joint extends through the strut bearing, and the propeller is affixed to the shaft behind the strut bearing. Top, bottom and side rudder plates may optionally be affixed to the strut bearing. The pivoting axis of the universal joint is aligned with the longitudinal axis about which the rudder shaft is pivotable, so that the strut bearing, short shaft, and propeller may be swung in either direction from the center line of the craft to an angle on the order of 45° by manipulation of its steering gear.

BRIEF DESCRIPTION OF THE DRAWINGS

In the drawings, wherein like numerals are employed to designate like parts throughout the same.

DESCRIPTION OF THE PREFERRED EMBODIMENT

Figures 1, 2:
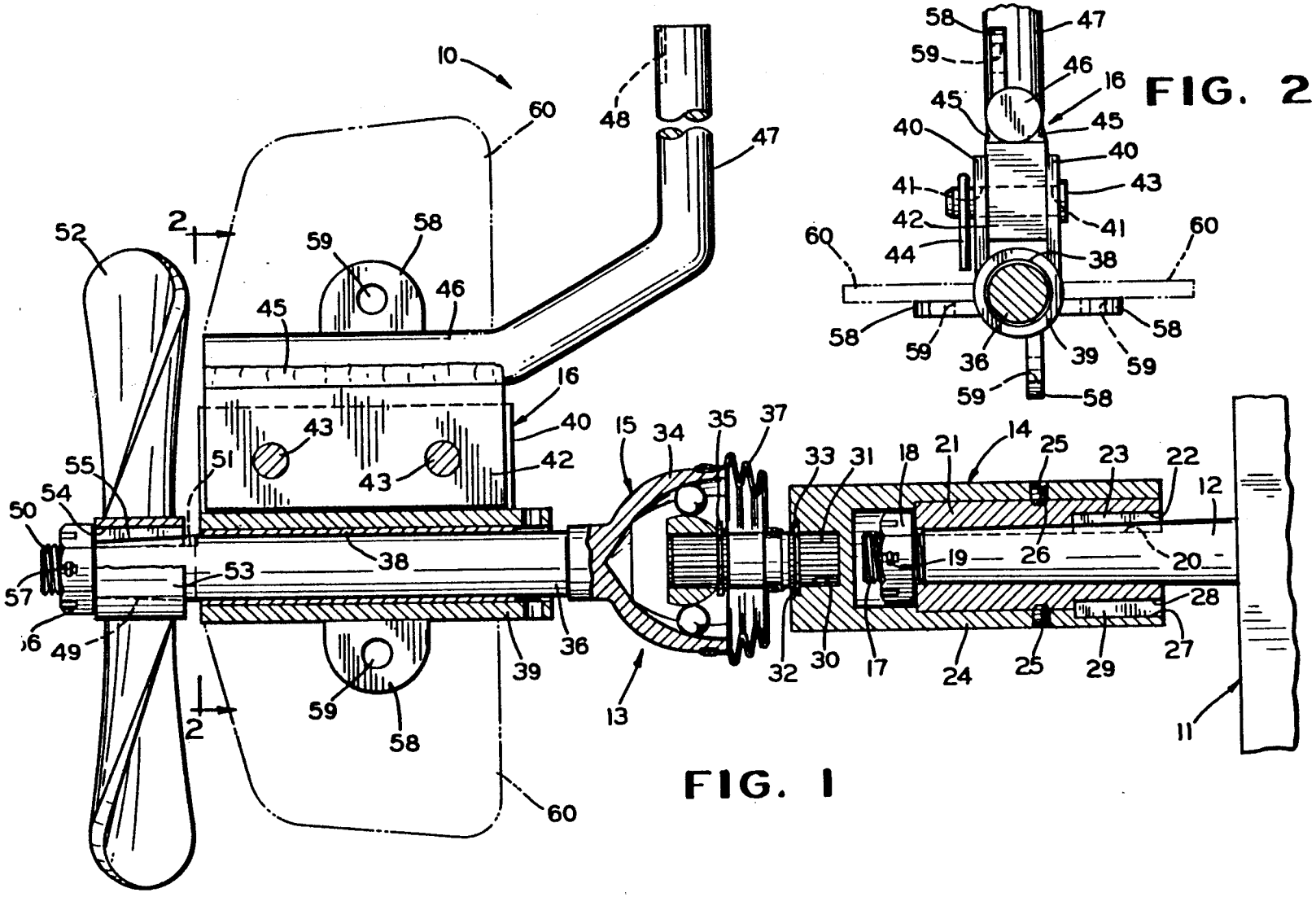
FIG. 1 is a longitudinal side view, partially in section, of the steerable propeller drive apparatus of the invention.
FIG. 2 is an end view, taken substantially along line 2—2 of FIG. 1.

Referring now to the drawings, and in particular to FIG. 1 thereof, there is illustrated a steerable propeller drive apparatus in accordance with the invention and comprehensively designated 10, mounted upon a watercraft whose rear transom portion is identified generally at 11. A drive shaft 12 extends through the transom 11 in the usual manner for such inboard straight-line powered craft. In conventionally steered craft of this type, the propeller is mounted directly on the shaft 12, and a separate rudder is independently mounted behind and in line with the propeller by means of a steering assembly extending upwardly and mounted in an extension of the hull of the craft (not shown) projecting rearwardly over the transom 11.

In accordance with the invention the direct mounted propeller and independent rudder are replaced by a steerable propeller unit, identified generally at 13 and comprising a coupling assembly 14, a universal joint and extension shaft assembly 15 and a rudder and strut bearing assembly 16. As will be seen in FIG. 1, the drive shaft 12 tapers inwardly and rearwardly and is provided with a threaded end 17 for receiving a lock nut 18 secured in the conventional manner by a cotter pin 19. The shaft 12 includes a longitudinally extending keyway 20. In the standard arrangement, a propeller fits on the tapered shaft and is affixed thereto for rotation by means of the keyway and the lock nut. The coupling assembly 14 which replaces the propeller, comprises a tubular adapter 21 having a tapered inner wall complementary to the tapered surface of the shaft 12 and provided with a keyway 22. The adapter 21 is thus adapted to slip onto the shaft and be securely affixed thereto by the nut 18 and a key 23 received in the keyways 20 and 22. A tubular sleeve 24 slips over the adapter 21 and is secured thereto as by set screws 25 received in recesses 26 in the adapter. The sleeve and adapter have matching keyways 27 and 28, respectively, for receiving a key 29 to lock the sleeve to the adapter for rotation therewith.

The rear end of the sleeve 24 is closed and is provided with a splined opening 30 for receiving the end of a correspondingly splined stub shaft 31. The stub shaft is retained within the opening by a snap ring 32 received within an annular recess 33. At its opposite end the stub shaft is received within a splined recess of a constant velocity universal joint 34 and locked thereto as by a snap ring 35. A propeller shaft 36 is suitably affixed to the rear section of the constant velocity joint. A flexible boot 37 surrounds the stub shaft and the forward end of the constant velocity joint for keeping water out of the joint.

The propeller shaft is journalled for rotation in a bearing insert 38 carried within a bearing housing 39 of the rudder and strut bearing assembly 16. As will be seen in FIGS. 1 and 2, there is affixed to the bearing housing 39 a spaced pair of upstanding elongated flanges 40. The spaced flanges are provided with pairs of aligned openings 41 as will be hereinafter more fully explained, and a mounting plate 42 of the rudder and strut bearing assembly 16 is received between the spaced flanges and removably fastened therein as by pins 43 extending through the openings 41 and secured by safety clips 44. The mounting plate, in turn, is affixed as by weldments 45 to a base leg 46 of a rudder arm 47. The rudder arm is provided at its upper end with suitable means including, for example, a key slot 48 for mating with and being coupled to the steering mechanism of the craft in place of the rudder post conventionally employed with the craft. Thus, the rudder arm 47 can simply be inserted in place of the regular rudder post for installing the rudder and strut bearing assembly 16 of the invention.

At its rear the propeller shaft 36 is formed with a tapered end 49 having a taper corresponding to the taper of the drive shaft 12 and terminating in a threaded portion 50. The tapered end is provided with a keyway 51 corresponding to the keyway 20 of the drive shaft 12. Thus, a propeller 52 having an internally tapered hub 53 provided with a keyway 54 suitable for mounting on the shaft 12, may alternatively be mounted on the propeller shaft 36 by means of a key 55 and locking nut 56 secured by a cotter pin 57.

While the steerable propeller of the invention by itself provides excellent maneuverability, it may further enhance the steering capability of the unit under some circumstances to additionally provide a steering rudder effect. To that end, the bearing housing 39 and the base leg 46 of the rudder arm may be provided with one or more rudder mounting tabs 58 along the sides or bottom of the bearing housing and the top of the base leg 46. The tabs include openings 59 by means of which rudder plates 60, shown in broken lines, may optionally be affixed as by bolts (not shown) to any or all of the tabs. As will be seen in FIG. 2, the rudder tabs are preferably offset from the center line of the rudder and strut bearing assembly by such a distance that a rudder plate mounted alongside the tab will be centered along the longitudinal axis of the steerable propeller drive apparatus 10.

Figure 3:
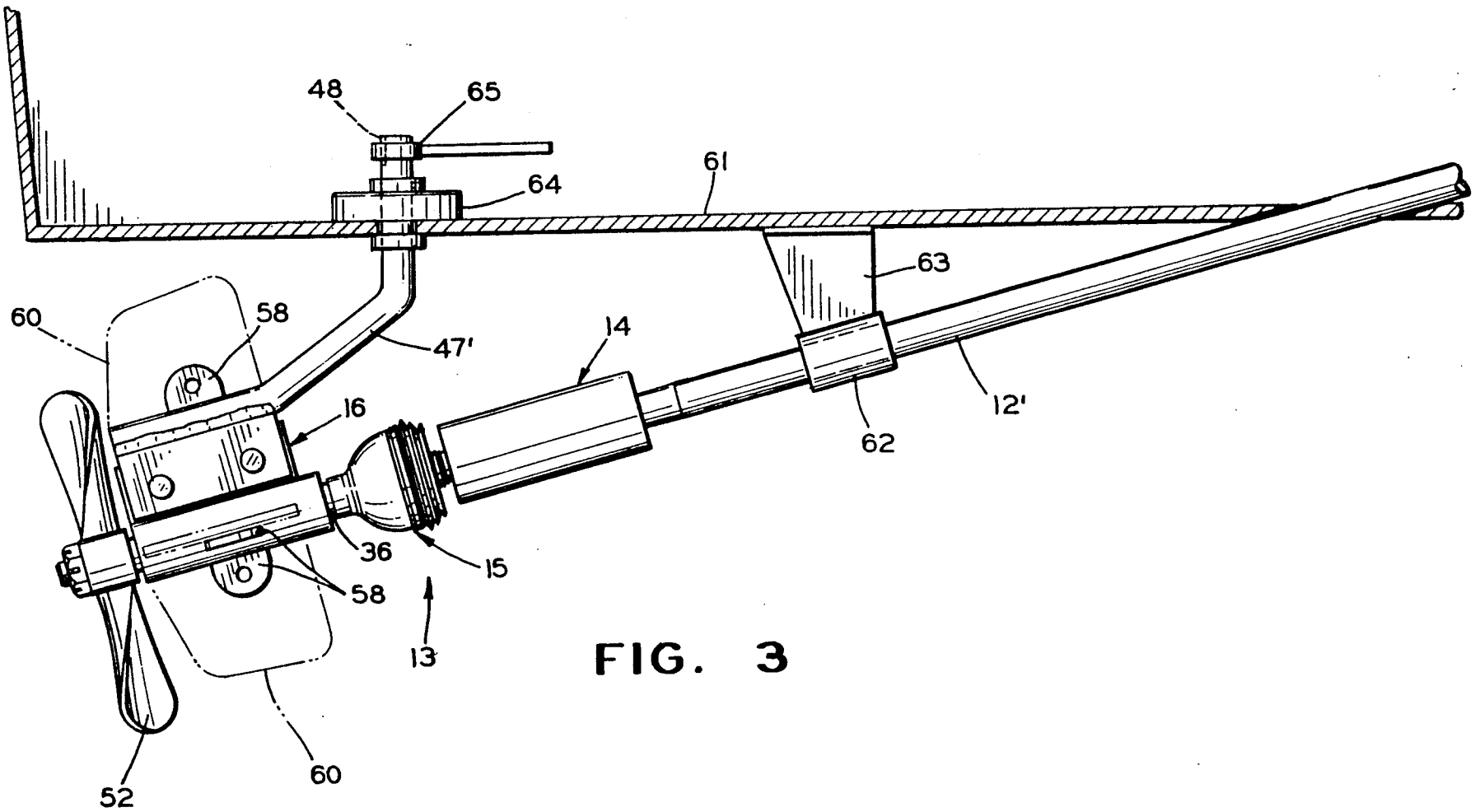
FIG. 3 is a longitudinal side view illustrating an alternate installation of the steerable propeller drive apparatus of the invention.

While the invention has been illustrated in FIG. 1 and described in detail as adapted to a watercraft having a drive shaft extending substantially horizontally through the rear transom of the craft, it will be understood that it can as well be employed with watercraft wherein the drive shaft projects rearwardly and angularly downwardly from the bottom of the craft as illustrated in FIG. 3. In such units a drive shaft 12' conventionally extends rearwardly and downwardly ahead of the transom 11 and through the bottom 61 of the watercraft. The shaft 12' extends through and is rotatably mounted within a support bearing 62 affixed to the bottom 61 by a bracket 63. A rudder arm 47' extends through and is rotatably mounted within a fitting 64 in the floor 61 in place of the rudder post conventionally provided with the craft. The rudder arm 47' is steerably coupled to the helm (not shown) of the craft as by conventional steering cables (also not shown) attached to a connector segment 65 within which the end of the rudder arm is received. The rudder arm is locked to the connector segment by a key received in the slot 48. The rudder arm 47 of the embodiment of FIG. 1 is similarly mounted in a fitting 64 carried by a floor or deck extension (not shown) extending rearwardly above the transom.

It is contemplated that the novel apparatus of the invention may be employed as original equipment on new watercraft, or may be made available in kit form for retrofitting on watercraft having conventional fixed propeller and steerable rudder systems. In any event, in adapting the apparatus for a particular line of watercraft, it is simply necessary to provide a coupling assembly 14 which will fit the drive shaft 12 of the craft, and a rudder and strut bearing assembly 16 wherein the rudder arm 47 is so dimensioned as to be coupled to the steering mechanism in place of the conventional rudder arm. For retrofitting on existing watercraft, the propeller is simply removed from the drive shaft 12 and mounted on the propeller shaft 36. The rudder arm and rudder are removed and the rudder arm 47, carrying the mounting plate 42, is inserted in its place. The coupling assembly 14 is affixed to the drive shaft 12, and the bearing housing 39 is affixed to the mounting plate by inserting the pins 43 and the safety clips 44. Although the openings 41 may initially be provided in the flanges 40 for standard installation, it is also contemplated that the bearing housing may be supplied without such openings so that they may be drilled during installation to permit some latitude in selecting the angular attitude of the propeller shaft 39 and propeller thereon relative to the plane of the watercraft.

It is to be understood that the forms of the invention herewith shown and described are to be taken as illustrative embodiments only of the same, and that various changes in the shape, size and arrangement of parts may be resorted to without departing from the spirit of the invention.

What is claimed is:

1. A steerable propeller unit for watercraft having an inboard mounted engine, a drive shaft extending rearwardly from the craft for driving a propeller normally removably affixed thereto and an inboard steering control means, comprising a coupling member affixed to said drive shaft, said coupling member including an adapter for fitting on said drive shaft in place of said propeller, first key means locking said adapter to said drive shaft for rotation therewith, a tubular sleeve adapted to fit over and be releasably secured to said adapter, and a second key means locking said tubular sleeve to said adapter for rotation therewith, universal joint means connected to said coupling member, a propeller shaft extending from said universal joint means, a bearing housing within which said propeller shaft is journaled for rotation, a propeller removably affixed to said propeller shaft, a rudder arm affixed to said bearing housing and supporting said bearing housing for a swinging movement about said universal joint means, and means releasably interconnecting said rudder arm to said steering control means whereby manipulation of said steering control means pivots said rudder arm and swings said propeller shaft and propeller thereon between selected angular positions relative to the center line of said watercraft.

2. A steerable propeller unit as claimed in claim 1, including a stub shaft interconnecting said tubular sleeve and said universal joint means.

3. A steerable propeller unit for a watercraft having an inboard mounted engine, a drive shaft extending rearwardly from the craft for driving a propeller and an inboard steering control means, comprising a coupling member affixed to said drive shaft, universal joint means connected to said coupling member, a propeller shaft extending from said universal joint means, a bearing housing within which said propeller shaft is journaled for rotation, a propeller removably affixed to said propeller shaft, a rudder arm affixed to said bearing housing and supporting said bearing housing for swinging movement about said universal joint means, said rudder arm including a base leg segment adapted to extend along said bearing housing, a mounting plate on said base leg segment for connecting said rudder arm to said bearing housing, and a leg extending upwardly from said base leg, said upwardly extending leg including means at its remote end for interconnecting with said steering control means whereby said upwardly extending leg is adapted to be rotated about its longitudinal axis for swinging said propeller shaft and propeller between selected angular positions, and means releasably interconnecting said rudder arm to said steering control means whereby manipulation of said steering control means pivots said rudder arm and swings said propeller shaft and propeller thereon between said selected angular positions relative to the center line of said watercraft.

4. A steerable propeller unit as claimed in claim 3, wherein said bearing housing includes a pair of spaced, upstanding flanges extending longitudinally therealong, said mounting plate being adapted to be secured between said spaced flanges for affixing said rudder arm to said bearing housing.

5. A steerable propeller unit as claimed in claim 4, including means defining aligned openings in said spaced flanges and said mounting plate, and pin means for extending through said aligned openings to releasably connect said rudder arm to said bearing housing.

6. A steerable propeller unit as claimed in claim 4, said coupling member comprising an adapter for fitting on said drive shaft in place of a propeller, a tubular sleeve adapted to fit over and be releasably secured to said adapter, first key means locking said adapter to said drive shaft for rotation therewith, and second key means locking said tubular sleeve to said adapter for rotation therewith, and including a stub shaft interconnecting said tubular sleeve and said universal joint means.

7. A steerable propeller unit for watercraft having an inboard mounted engine, a drive shaft extending rearwardly from the craft for driving a propeller and an inboard steering control means, comprising a coupling member affixed to said drive shaft, universal joint means connected to said coupling member, a propeller shaft extending from said universal joint means, a bearing housing within which said propeller shaft is journaled for rotation, a propeller removably affixed to said propeller shaft, a rudder arm affixed to said bearing housing and supporting said bearing housing for swinging movement about said universal joint means, said rudder arm including a base leg segment adapted to extend along said bearing housing and a mounting plate on said base leg segment for connecting said rudder arm to said bearing housing, first tab means extending from and along said base leg segment opposite said mounting plate, and means for selectively affixing a rudder plate to said tab means, and means releasably interconnecting said rudder arm to said steering control means whereby manipulation of said steering control means pivots said rudder arm and swings said propeller shaft and propeller thereon between selected angular positions relative to the center line of said watercraft.

8. A steerable propeller unit as claimed in claim 7, including second tab means extending from and along at least one of the positions including the opposite sides and the bottom of said bearing housing, and means for selectively affixing a rudder plate to said second tab means.

9. A steerable propeller unit for water craft having an inboard mounted engine, a drive shaft extending rearwardly from the craft for driving a propeller normally removably affixed thereto and an inboard steering control means, comprising a coupling member affixed to said drive shaft, said coupling member comprising an adapter for fitting on said drive shaft in place of said propeller, means locking said adapter to said drive shaft for rotation therewith, a tubular sleeve adapted to fit over and be releasably secured to said adapter, and means locking said tubular sleeve to said adapter for rotation therewith, universal joint means connected to said coupling member, a propeller shaft extending from said universal joint means, a bearing housing within which said propeller shaft is journaled for rotation, a propeller removeably affixed to said propeller shaft, a rudder arm affixed to said bearing housing and supporting said bearing housing for swinging movement about said universal joint means, and means releasably interconnecting said rudder arm to said steering control means whereby manipulation of said steering control means pivots said rudder arm and swings said propeller shaft and propeller thereon between selected angular positions relative to the center line of said watercraft.

10. A steerable propeller unit as claimed in claim 9 wherein said bearing housing includes a pair of spaced upstanding flanges extending longitudinally therealong for connecting said rudder arm to said bearing housing.

11. A steerable propeller unit as claimed in claim 9, wherein said rudder arm includes a base leg segment adapted to extend along said bearing housing and a mounting plate on said base leg segment for connecting said rudder arm to said bearing housing.

* * * * *